US006147455A

United States Patent [19]

Nerone

[11] Patent Number: 6,147,455

[45] Date of Patent: Nov. 14, 2000

[54] GAS DISCHARGE LAMP BALLAST CIRCUIT WITH ELECTRONIC STARTER

[75] Inventor: Louis R. Nerone, Brecksville, Ohio

[73] Assignee: General Electric Company, Schenectady, N.Y.

[21] Appl. No.: 09/324,566

[22] Filed: Jun. 2, 1999

[51] Int. Cl.[7] ..... H05B 39/00

[52] U.S. Cl. ..... 315/105; 315/106; 315/224

[58] Field of Search ..... 315/98, 106, 105, 315/107, 209 R, 209 T, 224, 289, 291, 307, 334, DIG. 2, DIG. 5, DIG. 7, 94, 95, 96, 97, 99, 103; 323/901

[56] References Cited

U.S. PATENT DOCUMENTS

| | | | |
|---|---|---|---|
| 2,928,990 | 3/1960 | Siljeholm et al. | 315/97 |
| 3,504,658 | 4/1970 | Chavis | 123/148 |
| 3,622,837 | 11/1971 | Gellman | 315/209 T |
| 3,720,861 | 3/1973 | Kahanic | 315/107 |
| 4,234,823 | 11/1980 | Charlot | 315/107 |
| 4,337,417 | 6/1982 | Johnson | 315/290 |
| 4,381,476 | 4/1983 | Adachi et al. | 315/101 |
| 4,419,607 | 12/1983 | Barakitis et al. | 315/73 |
| 4,489,255 | 12/1984 | Barakitis et al. | 315/73 |
| 5,010,274 | 4/1991 | Phillips et al. | 315/101 |
| 5,057,752 | 10/1991 | Grabner et al. | 315/289 |
| 5,059,870 | 10/1991 | Choon | 315/289 |
| 5,097,177 | 3/1992 | Chiang | 313/619 |
| 5,440,205 | 8/1995 | Tahara et al. | 315/94 |
| 5,532,555 | 7/1996 | Yamada | 315/241 P |
| 5,537,010 | 7/1996 | Johnson et al. | 315/289 |
| 5,543,690 | 8/1996 | Bernicke et al. | 315/224 |
| 5,594,308 | 1/1997 | Nuckolls et al. | 315/290 |
| 5,612,597 | 3/1997 | Wood | 315/DIG. 7 |
| 5,623,187 | 4/1997 | Caldeira et al. | 315/209 R |
| 5,694,007 | 12/1997 | Chen | 315/224 |
| 5,734,231 | 3/1998 | Lee et al. | 315/106 |
| 5,736,817 | 4/1998 | Rothenbuhler et al. | 315/106 |
| 6,011,362 | 1/2000 | Moisin | 315/307 |

OTHER PUBLICATIONS

"Silicon Bidirectional Switches—Diode Thyristors", Motorola Thyristor Device Data, pp. 3–196 through 3–199.

*Primary Examiner*—Don Wong
*Assistant Examiner*—Thuy Vinh Tran

[57] ABSTRACT

A ballast circuit with an electronic starter for a gas discharge lamp having a pair of cathodes is disclosed. The circuit comprises a main current path with a first leg connected to one cathode of the lamp and a second leg connected to the other cathode. The first leg includes an inductor. A starting current path is connected between the cathodes for enabling current build-up in the inductor during a lamp pre-start period. The starting current path includes a starter switch controllable by the voltage between a control node and a reference node of the switch. The starting current path allows cathode-to-cathode current flow when the starter switch is on. A control circuit is connected between the control node and the reference node of the switch for controlling the switch. The control circuit comprises a capacitor whose voltage is coupled between the control node and the reference node so as to control the switch, and a source of current for charging the capacitor. The control circuit further comprises a voltage-breakover (VBO) switch coupled to receive the voltage of the capacitor in order to be made conductive when that voltage reaches a sufficient level. The VBO switch is coupled between the reference node and the control node in a manner that maintains the voltage between those nodes at a sufficiently low level to keep the starter switch turned off after such switch is made conductive.

11 Claims, 2 Drawing Sheets

GAS DISCHARGE LAMP BALLAST CIRCUIT WITH ELECTRONIC STARTER

FIELD OF THE INVENTION

The present invention relates to ballast circuits for gas discharge lamps, and more particularly to a ballast circuit including an electronic starter for starting a lamp.

BACKGROUND OF THE INVENTION

Glow bottles serve as starters in ballast circuits for conventional fluorescent lamps. Initially, a glow bottle is in a low impedance state, causing current to build up in a ballast inductor in the ballast. As bimetallic contacts in the glow bottle become heated, the contacts separate, causing the inductor to transfer energy to the lamp for causing the lamp to ignite. Once ignition occurs, arc current in the lamp increases and the ballast inductor limits the current to the rating of the lamp.

However, the glow bottle has limitations. The lamp may not start on the first pulse, resulting in the bimetallic contacts cooling. The bimetallic contacts then close and cause current to build up in the ballast inductor. The start cycle then repeats, causing an annoying flicker in the lamp. It would be desirable to provide an economical lamp ballast overcoming these limitations.

SUMMARY OF THE INVENTION

In accordance with an exemplary embodiment, a ballast circuit with an electronic starter for a gas discharge lamp having a pair of cathodes is provided. The ballast comprises a main current path with a first leg connected to one cathode of the lamp and a second leg connected to the other cathode. The first leg includes an inductor. A starting current path is connected between the cathodes for enabling current build-up in the inductor during a lamp pre-start period. The starting current path includes a starter switch controllable by the voltage between a control node and a reference node of the switch. The starting current path allows cathode-to-cathode current flow when the starter switch is on. A control circuit is connected between the control node and the reference node of the switch for controlling the switch. The control circuit comprises a capacitor whose voltage is coupled between the control node and the reference node so as to control the switch, and a source of current for charging the capacitor. The control circuit further comprises a voltage-breakover (VBO) switch coupled to receive the voltage of the capacitor in order to be made conductive when that voltage reaches a sufficient level. The VBO switch is coupled between the reference node and the control node in a manner that maintains the voltage between those nodes at a sufficiently low level to keep the starter switch turned off after such switch is made conductive.

DETAILED DESCRIPTION OF THE INVENTION

Figure 1:
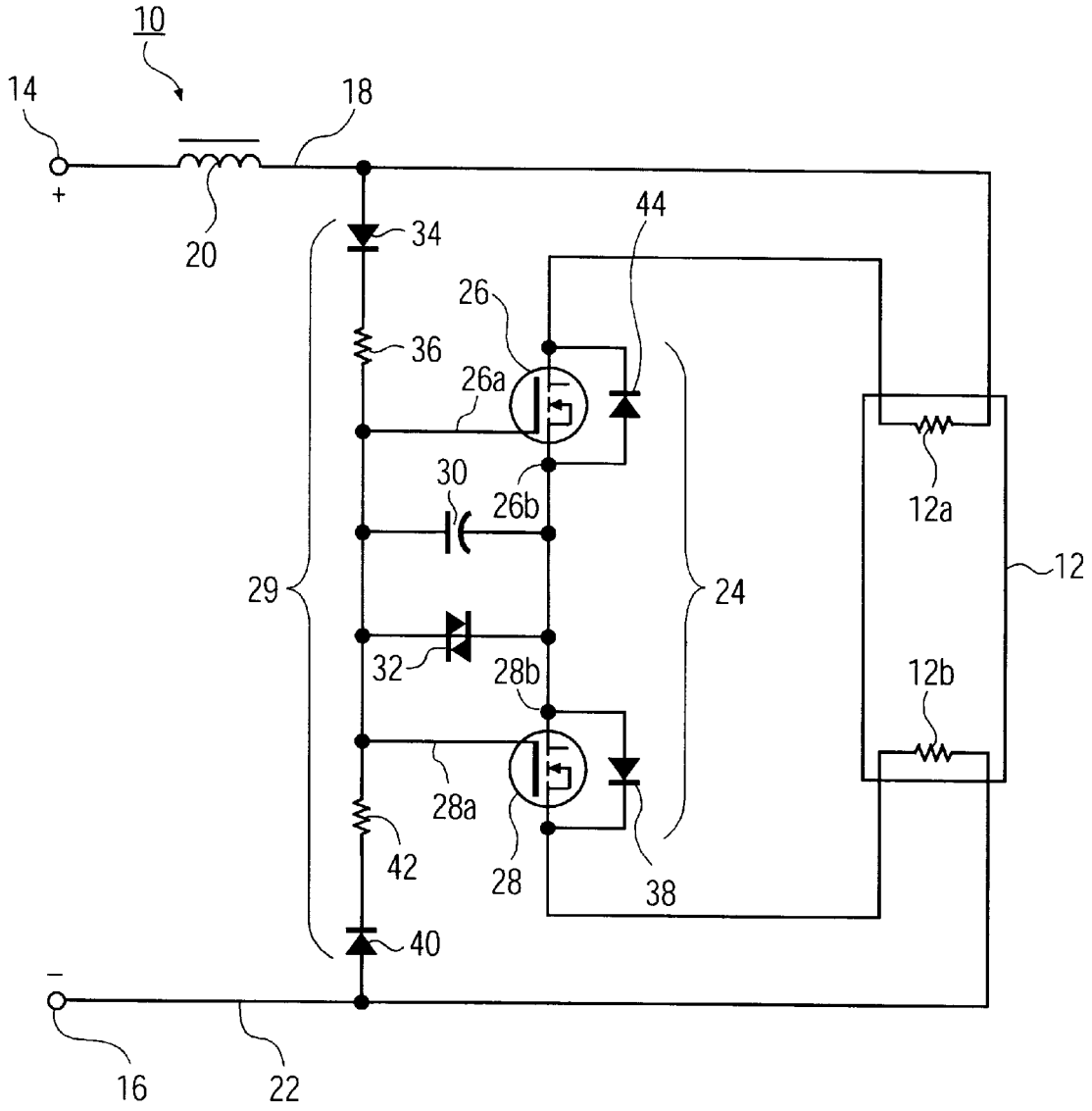
FIG. 1 is a schematic diagram of a ballast circuit of a preferred embodiment of the present invention.

FIG. 1 shows a ballast circuit 10 in accordance with a preferred embodiment of the invention. Ballast 10 includes a lamp 12, preferably, but not necessarily, including heatedfilament cathodes 12*a* and 12*b*. Lamp 12 may comprise a fluorescent lamp, for instance. A.c. voltage between nodes 14 and 16 powers lamp 12 during normal operation through a current leg 18 including an inductor 20, and a lower leg 22. More particularly, such current path supplies current to cathodes 12*a* and 12*b* when the lamp is on. A "starting" current path 24 includes "starter" switches 26 and 28, such as MOSFETs or Insulated Gate Bipolar Transistors, for allowing current flow from cathode 12*a* to cathode 12*b* and vice-versa during a lamp pre-start period. During the pre-start period, current from inductor 20 flows through switches 26 and 28, causing a build-up of energy in the inductor as explained more fully below.

A control circuit 29 controls operation of starter switches 26 and 28. Where switch 26 comprises a MOSFET, the voltage between its gate 26*a,* or control node, and its source 26*b,* or reference node, determines the conduction state of the switch. Switch 28 is controlled in the same manner, i.e., by the voltage between its control node 28*a* and its reference node 28*b.* Capacitor 30 is coupled between the control and reference nodes of the switches to control the switches. The coupling is preferably, but not necessarily, by direct connection between these nodes as shown.

A voltage-breakover device 32, such as a silicon bilateral switch (SBS), is coupled across capacitor 30 for turning off conductive path 24 after the lamp starts, as will be explained below.

When a.c. voltage is first applied between nodes 14 and 16, capacitor 30 may be charged by a current path, for current passing through inductor 20 from right to left, including a one-way current valve 34, such as a p-n diode, a resistor 36 and a further one-way current valve 38. Current valve 38 may comprise the intrinsic diode of a MOSFET, or a diode bonded to an IGBT, for instance. For current passing through inductor 20 in the opposite direction, a current path for charging capacitor 30 may include a one-way current valve 40, a resistor 42, and a further one-way current valve 44. Current valve 44 may comprise the intrinsic diode of a MOSFET, or a diode bonded to an IGBT, for instance. Resistors 36 and 42 limit the current through voltage-breakover device 32 and the capacitor 30.

A typical lamp starting process has three stages. These are described as follows.

Stage 1 of Starting

In the first stage, a.c. voltage is applied between nodes 14 and 16. Capacitor 30, whose initial voltage is zero, starts to charge by the current paths just described. When its voltage rises to a sufficient level, switches 26 and 28 are switched on, commencing the second stage.

Second Stage

With the switches turned on, current path 24 allows bidirectional cathode-to-cathode current flow. This increases the current in inductor 20, whose energy thus builds up during a lamp pre-start period. Beneficially, cathodes 12*a* and 12*b* become heated when such cathode-to-cathode current flows. Cathode-to-cathode current in path 24 continues during this period until the voltage across capacitor 30, which is coupled across voltage-breakover (VBO) device 30, causes the VBO device to switch on. Typically, this may occur at about 8–10 volts across the VBO device. This commences the third stage.

Third Stage

In the third stage, the voltage across VBO device 30, which has been switched on, drops to a value below that necessary to maintain the conductive state of the switches, so that the switches turn off. At this point, the so-interrupted current in inductor 20 causes a large L*di/dt voltage that is impressed across the lamp cathodes to start the lamp, where "L" is the inductance of inductor 20 and "di/dt" is the change in current in the inductor over time. The value of such voltage may be limited by operation of switches 26 and 28. When comprising MOSFETs, the switches will typically avalanche at some voltage above their rated voltage (e.g., avalanche at 650 volts when rated at 600 volts).

As long as the VBO device is supplied with its so-called holding current, typically about one milliamp, e.g., via resistors 36 and 42, it remains conducting and prevents the switches in current path 24 from conducting. If the ballast is designed properly, the lamp will start when the mentioned L*di/dt voltage is created in inductor 20, and no flickering of light will occur during lamp starting.

Exemplary values for ballast 10 of FIG. 12 are as follows:

| COMPONENT OR FUNCTION | VALUE |
|---|---|
| Lamp 12 | A 26-watt fluorescent lamp having 3-ohm cathodes. |
| A.c. voltage applied between nodes 14 and 16 | 277 volts for the 277-volt ballast shown. |
| Inductor 20 | 2 Henries. |
| Resistors 36 and 42 | 10 k and 10 k ohms, respectively. |
| Capacitor 30 | 10 microfarads. |
| Silicon Bilateral Switch 32 | A MBS4992 switch sold by Motorola of Phoenix, Arizona. |
| Switches 26 and 28 | Model MTD1N60 n-channel MOSFETs sold by Motorola of Phoenix, Arizona. |

Figure 2:
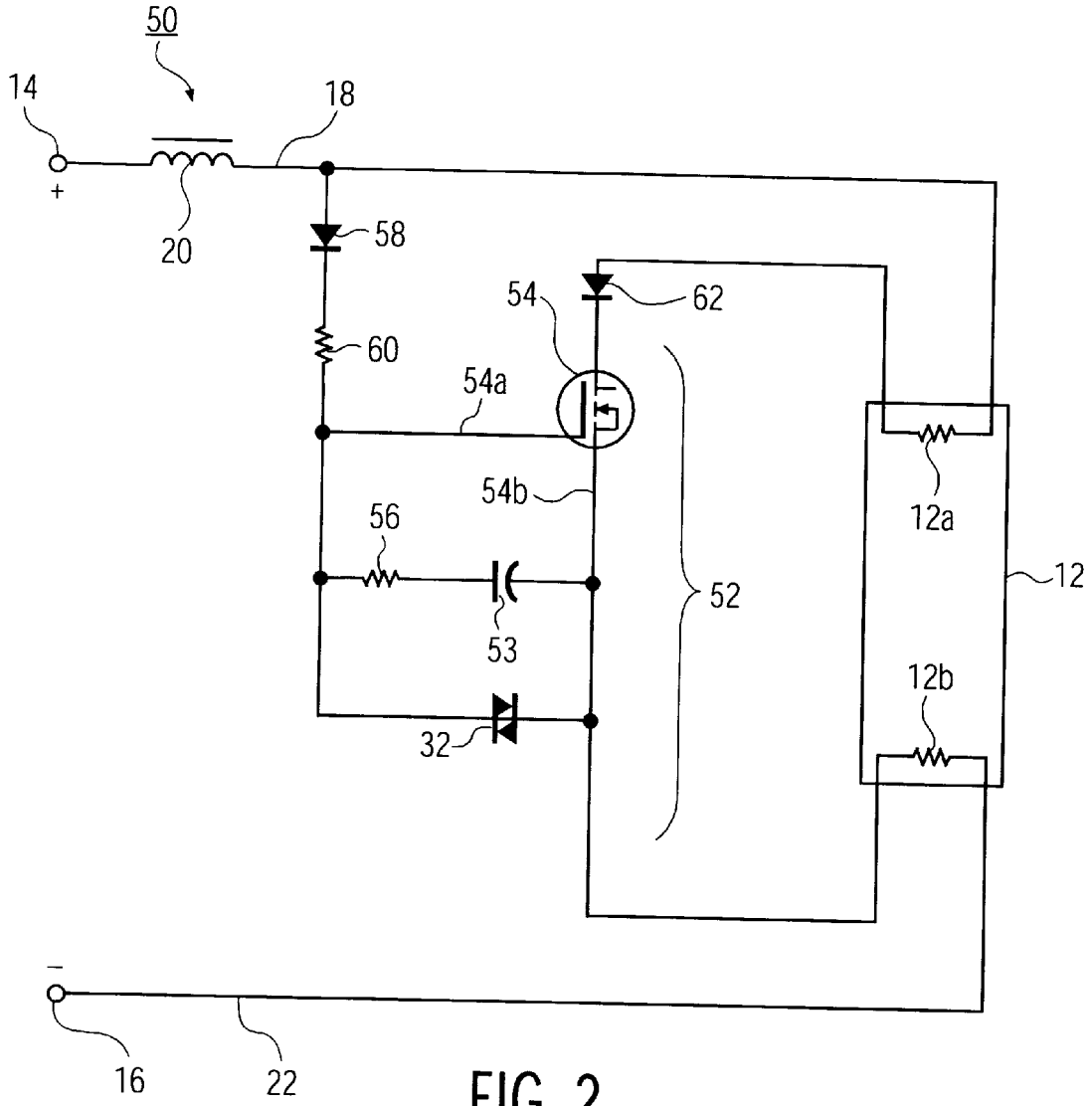
FIG. 2 is a schematic diagram of a ballast circuit of another embodiment of the invention.

FIG. 2 shows a ballast 50 according to a further embodiment of the invention, which uses fewer components than the embodiment of FIG. 1. Like parts as between FIGS. 1 and 2 refer to like parts. A "starting" current path 52 includes a switch 54 controlled in response to a voltage between its control node 26*a* (e.g., a gate of a MOSFET) and its reference node 26*b* (e.g., a source of a MOSFET). A capacitor 53 is coupled between control node 54*a* and reference node 54*b* so that its voltage controls switch 54. A resistor 56 controls the discharge rate of capacitor 53 through VBO device 32.

A path for charging capacitor 53 when voltage is applied between nodes 14 and 16 includes a one-way current valve 58 such as a p-n diode, a resistor 60, resistor 56, and cathode 12*b*. In contrast to capacitor 30 of FIG. 1, capacitor 53 of FIG. 2 is charged only by every other half cycle of current supplied through main current path legs 18 and 22. Capacitor 53 becomes charged in this manner until its voltage reaches a level sufficient to turn on switch 54. This allows current flow from cathode 12*a* to cathode 12*b*, but not in the other direction due to the presence of one-way current valve 62 such as a p-n diode. Owing to such current flow, energy becomes stored in inductor 20.

When the voltage across capacitor 53 rises to a sufficient level, the coupling of that voltage across a voltage-breakover (VBO) device 32, such as a silicon bilateral switch, via resistor 56 causes that device to switch on and drop in voltage so as to turn off switch 54. This stops current flow from cathode 12*a* to cathode 12*b* in current path 52, and results in a large L*di/dt voltage across the lamp for starting the lamp. In the same manner as explained above for the embodiment of FIG. 1, the value of such voltage may be limited by operation of switch 54, which, when comprising a MOSFET, typically exhibits an avalanche condition.

As long as VBO device 32 is supplied with its holding current, e.g., via resistor 60, it remains conductive and prevents cathode-to-cathode current flow in path 52. This prevents flickering of the lamp during starting.

Exemplary values for ballast 50 of FIG. 2 are as follows:

| COMPONENT OR FUNCTION | VALUE |
|---|---|
| Lamp 12 | A 26 watt fluorescent lamp having 3 ohm cathodes. |
| A.c. voltage applied between nodes 14 and 16 | 277 volts. |
| Inductor 20 | 2 Henries. |
| Resistors 56 and 60 | 100 and 10 k ohms, respectively. |
| Capacitor 53 | 100 microfarads. |
| Silicon Bilateral Switch 32 | A MBS4992 switch sold by Motorola of Phoenix, Arizona. |
| Switch 54 | A model MTD1N60 n-channel MOSFET sold by Phoenix, Arizona. |

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit with an electronic starter for a gas discharge lamp having a pair of cathodes, comprising:

a) a main current path with a first leg connected to one cathode of the lamp and a second leg connected to the other cathode; the first leg including an inductor;

b) a starting current path connected between the cathodes for enabling current build-up in the inductor during a lamp pre-start period; the starting current path including:

i) a starter switch controllable by the voltage between a control node and a reference node of the switch;

ii) the starting current path allowing cathode-to-cathode current flow when the starter switch is on;

c) a control circuit connected between the control node and the reference node of the switch for controlling the switch, comprising:

i) a capacitor whose voltage is coupled between the control node and the reference node so as to control the switch;

ii) a source of current for charging the capacitor; and iii) a voltage-breakover (VBO) switch coupled to receive the voltage of the capacitor in order to be made conductive when that voltage reaches a sufficient level, and coupled between the reference node and the control node in a manner that maintains the voltage between those nodes at a sufficiently low level to keep the starter switch turned off after the VBO switch is made conductive.

2. The ballast circuit of claim 1, wherein the capacitor and the voltage-breakover switch are each directly connected between the control node and the reference node of the starter switch.

3. The ballast circuit of claim 1, wherein:

a) the starting current path further includes a second starter switch controllable by the voltage between a control node and a reference node of the switch;

b) the voltage of the capacitor is coupled between the foregoing control node and the foregoing reference node so as to control the second starter switch; and c) the current path for charging the capacitor includes first and second one-way current valves respectively bypassing the first-mentioned starter switch and the second starter switch.

4. The ballast circuit of claim 1, wherein the voltage-breakover switch comprises a silicon bilateral switch.

5. The ballast circuit of claim 1, wherein:

a) the cathodes comprise resistively heated cathodes; and b) the control circuit is arranged to substantially preheat the cathodes during the lamp pre-start period.

6. The ballast circuit of claim 5, wherein the lamp comprises a fluorescent lamp.

7. A ballast circuit with an electronic starter for a gas discharge lamp having a pair of cathodes, comprising:

a) a main current path with a first leg connected to one cathode of the lamp and a second leg connected to the other cathode; the first leg including an inductor;

b) a starting current path connected between the cathodes for enabling current build-up in the inductor during a lamp pre-start period; the starting current path including:

i) a starter switch controllable by the voltage between a control node and a reference node of the switch;

ii) the starting current path allowing cathode-to-cathode current flow when the starter switch is on;

c) a control circuit connected between the control node and the reference node of the switch for controlling the switch, comprising:

i) a capacitor whose voltage is coupled between the control node and the reference node so as to control the switch;

ii) circuitry coupled to the main current path for charging the capacitor when the main current path is initially energized; and iii) a voltage-breakover (VBO) switch coupled to receive the voltage of the capacitor in order to be made conductive when that voltage reaches a sufficient level, and coupled between the control node and the reference node in a manner that maintains the voltage between those nodes at a sufficiently low level to keep the starter switch turned off after the VBO switch is made conductive.

8. The ballast circuit of claim 7, wherein the starting current path allows bidirectional cathode-to-cathode current flow when the starter switch is on.

9. The ballast circuit of claim 7, wherein the voltage-breakover switch comprises a silicon bilateral switch.

10. The ballast circuit of claim 7, wherein:

a) the cathodes comprise resistively heated cathodes; and b) the control circuit is arranged to substantially preheat the cathodes during the lamp pre-start period.

11. The ballast circuit of claim 10, wherein the lamp comprises a fluorescent lamp.

* * * * *